United States Patent [19]

Sheu

[11] Patent Number: 4,795,064

[45] Date of Patent: Jan. 3, 1989

[54] GAS HEATED GLUE GUN

[76] Inventor: Sea M. Sheu, No. 24-2, Ho Chuan Lane, Chien Hsing Road, Chien Min Village, Ta Li Hsiang, Taichung Hsien, Taiwan

[21] Appl. No.: 156,470

[22] Filed: Feb. 16, 1988

[51] Int. Cl.[4] ..... B67D 5/62

[52] U.S. Cl. ..... 222/113; 222/146.2; 126/401; 401/1

[58] Field of Search ..... 222/113, 146.2, 146.1; 239/135, 139; 126/401, 409, 414; 228/53; 401/1–2; 431/256

[56] References Cited

U.S. PATENT DOCUMENTS 3,261,390 7/1966 Saito et al. ..... 222/146.2 X 4,262,820 4/1981 Flint ..... 222/146.2

4,502,465 3/1985 Yoshinaga et al. ..... 126/409

4,535,916 8/1985 Mächerle et al. ..... 126/414 X 4,755,073 7/1988 Girardin et al. ..... 126/401 X

*Primary Examiner*—Joseph J. Rolla

*Assistant Examiner*—Nils E. Pedersen

*Attorney, Agent, or Firm*—Keaty & Keaty

[57] ABSTRACT

A glue gun is provided, structured for the reception of a chamber that is a self-contained supply of gas for heating of glue. The operator can operate the glue gun by moving the trigger rearwards to produce a spark and to allow gas to flow from the gas chamber to the combustion chamber. The flow rate of the gas can be controlled by adjusting the protruder that projects from the window of the body portion.

7 Claims, 4 Drawing Sheets

GAS HEATED GLUE GUN

BACKGROUND OF THE INVENTION

The present invention relates generally to glue guns, and more particularly, to a gas heated glue gun with self-contained gas chamber.

Hot melt glue guns have been widely used in repairing chairs, restoring furniture, and laying electrical circuits, as well as bonding car carpets, laying tiles and gluing of wire netting, etc. The power supply to such a conventional glue gun is often an electrical current supply which is indeed very convenient in normal working conditions, but not when gluing procedures are to be completed at an isolated locality where power an electrical power supply is not accessible.

SUMMARY OF THE INVENTION

It is a primary object of the present invention to provide a glue gun having its heat supplied by gas combustion.

A further object of the present invention is to provide a glue gun with self-contained gas chamber and ignition system.

Another object of the present invention is to provide a glue gun which is adapted to be used suitably and conveniently at an isolated locality where electricity is not accessible.

These and additional objects, if not set forth specifically herein, will be readily apparent to those skilled in the art from the detailed description provided hereinbelow, with appropriate reference to the accompanying drawings.

DETAILED DESCRIPTION OF THE PREFERRED EMBODIMENT

Figure 1:
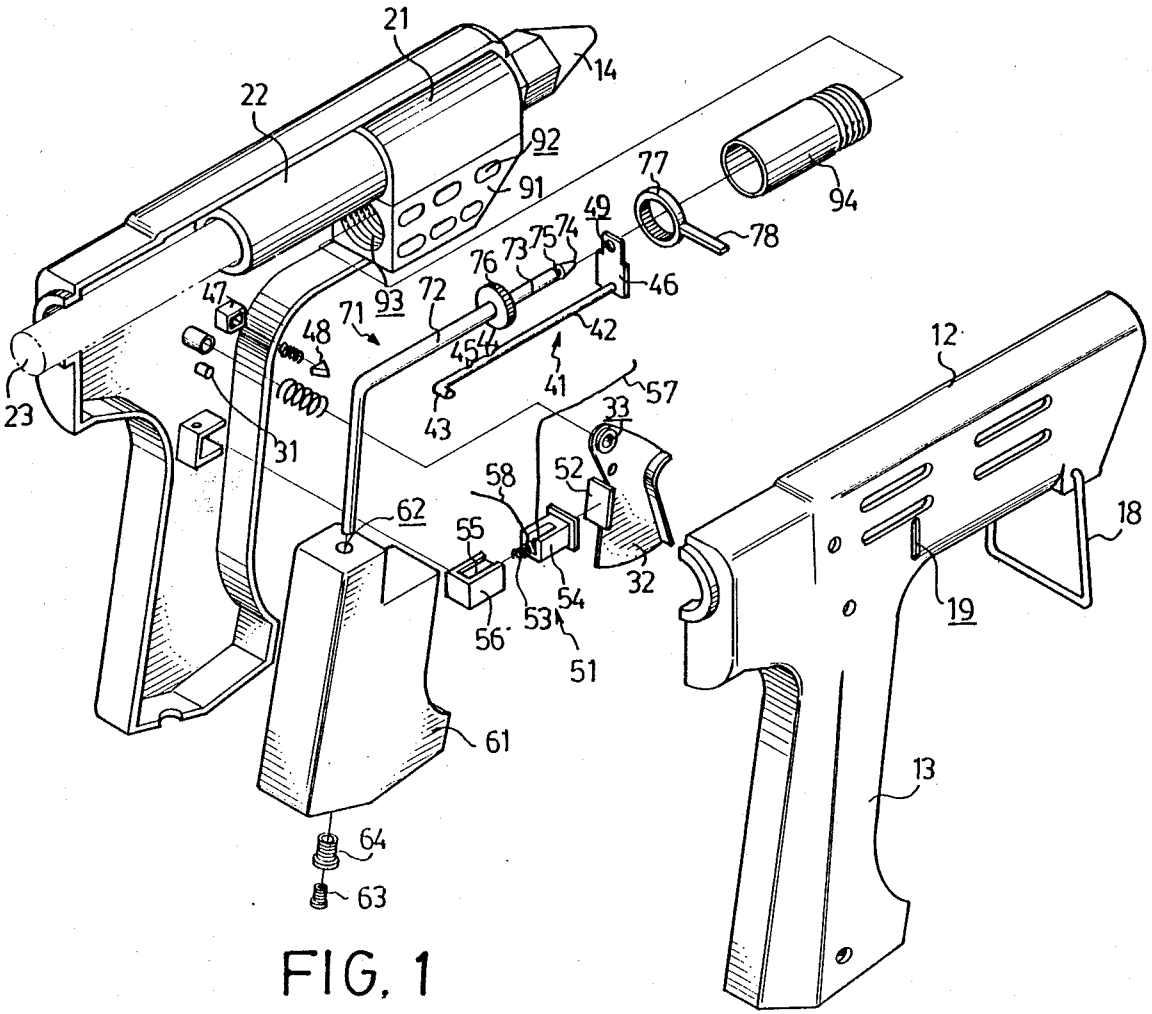
FIG. 1 is an exploded view of a glue gun in accordance with the present invention.
Figure 3:
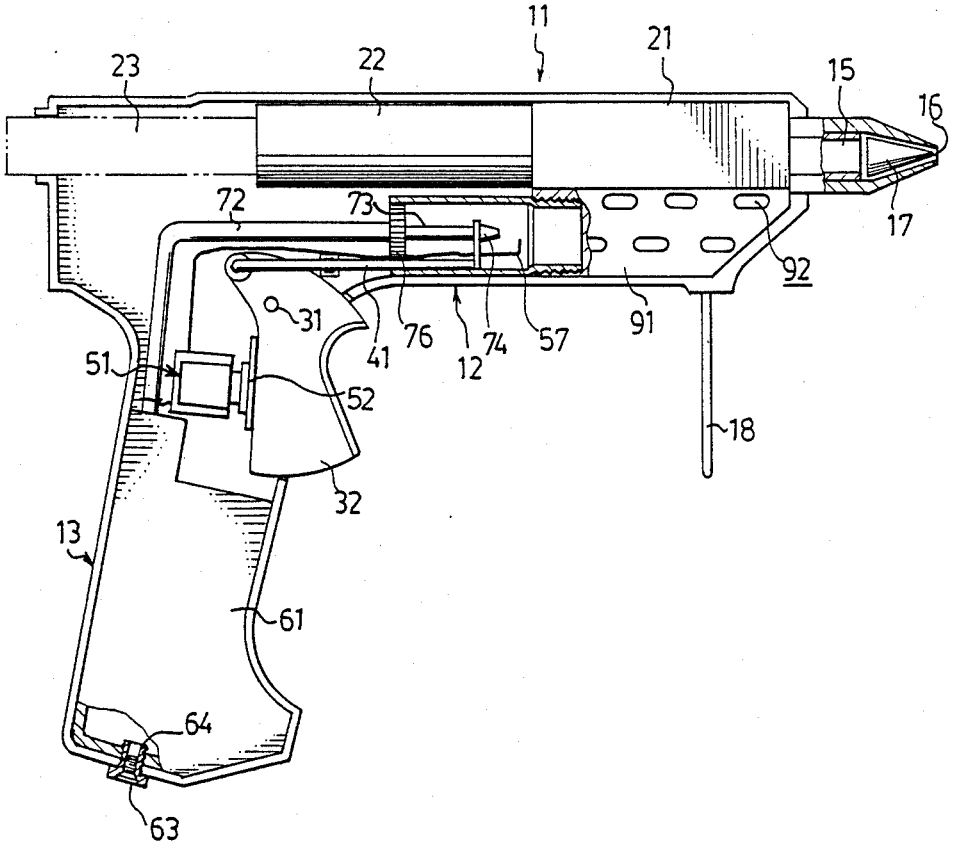
FIG. 3 is an elevational view of the glue gun shown in FIG. 1, the casing having been broken away for clarity, showing the trigger when it is fully extended.

Referring to the drawings and initially to FIGS. 1 and 3, the glue gun, generally indicated by reference numeral 11, includes a body portion 12 and a handle portion 13. Projecting from the body portion 12 is a gluing member 14. The gluing member 14 includes a tube 15 having a gluing tip 16 and a leak-proof cone 17. A metal stand 18 is provided on a lower side of the body portion 12 to support the glue gun 11 immediately after use so as to prevent any undesirable contact between the hot gluing member 14 and the bench or floor which might be finely decorated. A window 19 is provided on one side of the body portion 12 for a protruder of a ring for controlling purpose which will be described more fully hereinbelow.

A melt cartridge 21 is provided within the body portion 12 proximate to the gluing member 14. A guiding conduit 22 that is open at both ends thereof is provided within the body portion 12, immediately adjacent to the melt cartridge 21, for receiving a glue stick 23.

A pivot 31 is provided on the interior of the body member 12. Rotatably positioned on the pivot 31 is a trigger 32. The upper end of the trigger 32 has a hole 33 and is in communication with a drawing means, generally indicated by reference numeral 41. The lower portion of the trigger 32 is in communication with a sparking means, generally referred to by reference numeral 51.

Drawing means 41 is activated by the trigger 32. The drawing means 41 is generally a shaft 42 having an end part 43 extending laterally. The laterally extending end part 43 inserts through the hole 33 of the trigger 32 so as to be in engagement therewith and is secured to the body member 12 in any suitable manner, such as securing to a circular socket formed on an inner surface of the body member 12 with the aid of a coil spring to stay in place, as depicted.

The shaft 42 includes a first notch 44 and a second notch 45 along its length, and an integrally perpendicularly formed pulling plate 46 at an end remote from the laterally extending end part 43. The first and second notches 44 and 45 are provided such that the drawing means 41 is held in some particular positions on the body member 12. This can be accomplished in any suitable manner, such as forming a rectangular socket 47 on an inner face of the body member 12, wherein the rectangular socket 47 has a triangular body 48 therein, as depicted. The triangular body 48 is usually spring enforced so as to stay secure. The pulling plate 46 is a flat plate having a hole 49 thereon for encircling a gas control means, generally referred to by reference numeral 71.

Sparking means 51 is also activated by the trigger 32. Sparking means 51 includes a stop plate 52 in contact with the trigger 32, a coil 53, a coil retainer 54 for retaining the coil 53, a crystal 55 encircled by the coil 53, a container 56 for retaining the crystal 55, and two distinct wires 57 and 58 extending from the coil 53. The extending wire 57 extends to a location proximate to an end of a gas control means 71; the extending wire 58 is preferably electrically connected to the gas control means 71 at another end. The gas control means 71 will be described in detail more fully hereinbelow.

The glue gun 11 is provided with a gas supply means, generally indicated by reference numeral 61. The gas supply means 61 is located inside the barrel of the glue gun 11, preferably at the location with respect to the handle portion 13. The gas supply means 61 is generally a gas chamber having an opening 62 at an upper side thereof. The gas supply means 61 further includes a gas nozzle 63 and a gas valve 64 at the bottom side thereof for filling or injecting gas thereinto. The opening 62 is, in turn, connected to the gas control means 71.

The gas control means 71 includes a first hose 72 having an end connected to the opening 62 of the gas chamber 61, as mentioned previously, and a second hose 73 having an end part provided with a nozzle 74. The second hose 73 is provided with a circumferential notch 75 therearound at a position proximate to the nozzle 74 such that the second hose 73 can be firmly fixed in the hole 49 of the pulling plate 46 of the drawing means 41 when the second hose 73 inserts into the hole 49, with the circumferential notch 74 being firmly caught by the pulling plate 46.

The gas control means 71 further includes an adjustable dial 76 covered with a ring 77 having a protruder 78. The protruder 78 projects from the body member 12 through the previously mentioned window 19 after installation of each components in the barrel of the device 11. The adjustable dial 76 is provided at the junction of the first hose 72 and second hose 73.

Figure 2:
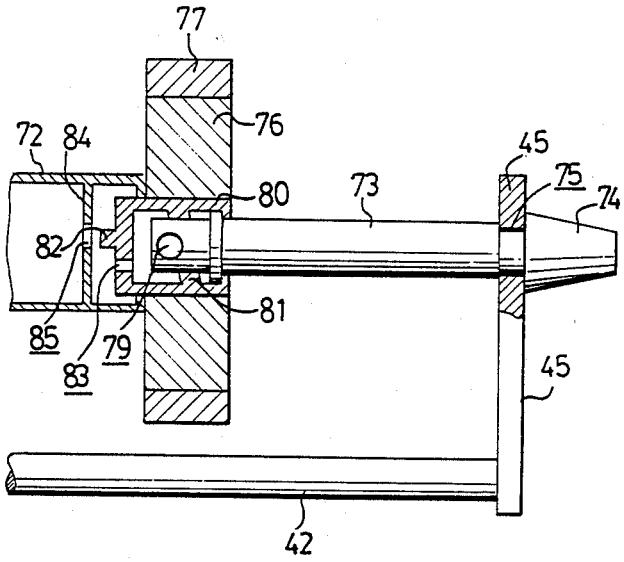
FIG. 2 is an enlarged, fragmentary view of the gas control means in accordance with the present invention.

The way the first hose 72 and the second hose 73 are joined together is depicted most clearly in FIG. 2. The first hose 72 has a larger diameter; the second hose 73 has a smaller diameter. The second hose 73 is provided with an inlet 79 near its interconnection part with the first hose 72. A sleeve 80, substantially covered with the previously mentioned adjustable dial 76 and ring 77, is rotatably mounted on the second hose 73 and covers the inlet 79. The sleeve 80 has a helical flange 81 on its inner wall. The sleeve 80 is further provided with a plug 82 and an aperture 83 on its outer face. The portion of the sleeve 80 not covered by the adjustable dial 76 is covered by the first hose 72. The first hose 72 is internally provided with a plate 84 having an opening 85. The opening 85 is closeable by the plug 82.

Referring again to FIG. 1, a combustion chamber 91 is provided within the body member 12 at a location below the melt cartridge 21. The combustion chamber 91 includes a plurality of vents 92 for the purpose of heat dissipation. The sidewall of the combustion chamber 91 is preferably cushioned with a layer of asbestos (not shown) so as to protect the body portion 12 from being damaged by heat. The end part of the combustion chamber 91 is provided with a bore 93 in which a cylindrical tube 94 can be installed. The cylindrical tube 94 is provided so as to receive the nozzle 74 of the control hose 71.

Figure 4:
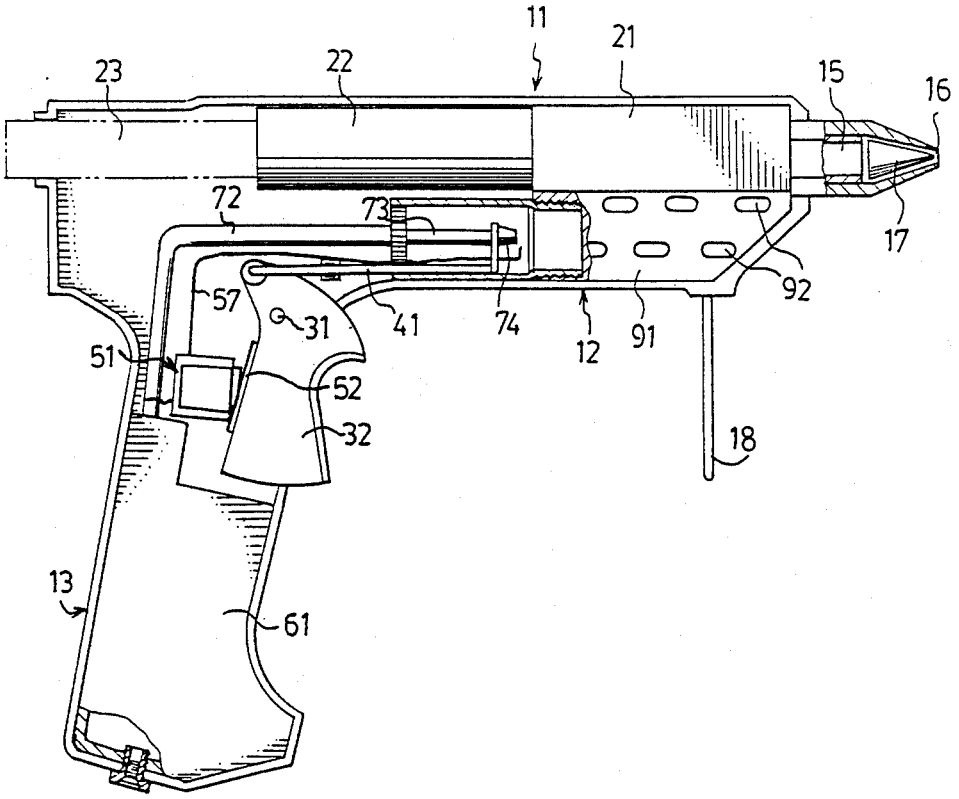
FIG. 4 is an elevational view of the glue gun, with the casing broken away and with the trigger fully depressed.

With particular reference to FIGS. 3 and 4, the manner in which the glue gun 11 is manipulated or operated will now be described in detail.

When the glue gun 11 is not in use, the trigger 32 stays at its fully extended state, as depicted clearly in FIG. 3. The operator may operate the glue gun 11 by moving the trigger 32 to its rearmost position or its fully depressed state, as depicted in FIG. 4.

The stop plate 52 urges the coil retainer 54 in rearward direction and finally abuts against the container 56. This causes mechanical stress on the crystal 55 and produces a piezoelectricity. As previously mentioned, the gas control means 71 is electrically connected with the wire 58 and the terminal of the wire 57 is very close to the end part of the gas control means 71, thereby subatantially forming a "circuit". The small distance between the nozzle 74 and the terminal of the wire 57 acts as a spark gap. Thus, a spark is produced at the position near the combustion chamber 91, due to the polarization of the above-mentioned "circuit", when the trigger 32 is moved rearwardly.

The drawing means 41, which is also activated by the trigger 32, moves forwards. The triangular body 48 initially catching the first notch 44 now catches the second notch 45.

The gas control means 71, as previously mentioned, is in communication with the drawing means 41 which in turn is in communication with the trigger 32. Thus, the gas control means 71 is simultaneously activated by the action of the trigger 32.

The pulling plate 46, being drawn by the trigger 32, draws the second hose 73 forwards. With reference to FIG. 2 again, the plug 82 of the sleeve 80 detaches from the opening 85 of the plate 84 of the first hose 72, thereby forming a passage for the gas. Gas thus flows from the gas chamber 61 through the opening 62, the passage thus formed, the aperture 83, the air inlet 79, and finally, the nozzle 74 and enters the combustion chamber 91 for combustion.

The flow rate of the gas is substantially determined by the size of the inlet 79. The rotatable sleeve 80 is adjustable by fastening the protruder 78 of the ring 77 through the window 19. The helical flange 81 of the sleeve 80, being slidable around the second hose 73, may completely cover the inlet 79, or partially cover the inlet 79, or not cover the inlet 79 at all. When the helical flange 81 does not cover the inlet 7 at all, the flow rate of the gas is the maximum. When the helical flange 81 partially covers the inlet 79, then the flow rate may be determined by the area of exposure of the inlet 79, or the area of the inlet 79 not covered by the helical flange 81.

While the present invention has been explained in relation to its preferred embodiment, it is to be understood that various modifications thereof will be apparent to those skilled in the art upon reading this specification. Therefore, it is to be understood that the invention disclosed herein is intended to cover all such modifications as fall within the scope of the appended claims.

I claim:

1. A gas heated glue gun (11) comprising:

a body portion (12), a handle portion (13), a gluing member (14) projecting from said body portion (12); a window (19) on one side of said body portion (12);

a melt cartridge (21) provided within said body portion (12) proximate to said gluing member (14); a guiding conduit (22) being provided within said body portion (12) immediately adjacent to said melt cartridge (21) for receiving a glue stick (23);

a trigger (32) pivotably mounted within said body portion (12);

a drawing means (41) located for communication with said trigger (32); said drawing means (41) being generally a shaft (42) having a laterally extending end part (43) for engaging with said trigger (32), and an integrally perpendicularly formed pulling plate (46) at an end remote from said laterally extending end part (43); said pulling plate (46) being a flat plate having a hole (49) thereon;

a sparking means (51) located for communication with said trigger (32); said sparking means (51) including a stop plate (52) in contact with said trigger (32), a crystal (55) encircled by a coil (53), and two distinct wires extending from said coil (53); a first said extending wire (57) extending to a location proximate to an end of a gas control means; a second said extending wire (58) being electrically connected to said gas control means at another end;

a gas supply means (61) being a gas chamber having an opening (62) at an upper side thereof; said gas supply means (61) further including a gas nozzle (63) and a gas valve (64) at a bottom side thereof for filling gas thereinto;

said gas control means (71) including a first hose (72) having an end connected to said opening (62) of said gas chamber (61), and a second hose (73) receivable by said drawing means (41); said second hose (73) having an end part provided with a nozzle (74); said second hose (73) being receivable by said drawing means (41); said gas control means (71) further including an adjustable dial (76) covered with a ring (77) having a protruder (78); said protruder (78) being manually operable and projecting from said body portion (12) through said window (19); said second hose (73) being provided with an inlet (79) near an interconnection part with said first hose (72); a sleeve (80) partially covered with said adjustable dial (76) and ring (77) being rotatably mounted on said second hose (73) and covering said inlet (79); said sleeve (80) having a helical flange (81) on the inner wall thereof and being provided with a plug 82 and an aperture (82) on an outer face thereof; said helical flange (81) being slidable around said second hose (73) so as to cover said inlet (79) to different extents; said first hose (72) being partially mounted on said sleeve (80); said first hose (72) being internally provided with a plate (83) having an opening (84); said opening (84) being insertable by said plug (82); said plug (82) being detachable from said opening (84) to form a passage for gas; and a combustion chamber (91) including a plurality of vents (92), an end part of said combustion chamber (91) being provided with a bore (93) for receiving a cylindrical tube (94).

2. A glue gun (11) as set forth in claim 1, wherein said gluing member (14) includes a tube (15) having a gluing tip (16) and a leak-proof cone (17).

3. A glue gun (11) as set forth in claim 1, wherein said body portion (12) is provided with a metal stand (18) on a lower side thereof.

4. A glue gun (11) as set forth in claim 1, wherein said trigger (32) is provided with a hole (33) on an upper end thereof.

5. A glue gun (11) as set forth in claim 1, wherein said shaft (42) comprises a first notch (44) and a second notch (45), such that said drawing means (41) is holdable in some particular positions.

6. A glue gun (11) as set forth in claim 1, wherein said sparking means (51) comprises a coil retainer (54) for retaining said coil (53) and a container (56) for retaining said crystal (55).

7. A glue gun (11) as set forth in claim 1, wherein said second base (73) is provided with a circumferential notch (75) therearound at a position adjacent to said nozzle (74) such that said second hose (73) is firmly fixed in said hole (49) of said pulling plate (46) of said drawing means (41) when said second hose (73) inserts into said hole (49), with said circumferential notch (74) being caught by said pulling plate (46).

* * * * *